US006158804A

United States Patent [19]

Luvisch

[11] Patent Number: 6,158,804

[45] Date of Patent: Dec. 12, 2000

[54] APPARATUS ASSISTING IN RISING FROM SEATED POSITION

[76] Inventor: Harold M. Luvisch, 5583 Sugar Mill Ct., Delray Beach, Fla. 33484

[21] Appl. No.: 09/523,713

[22] Filed: Mar. 13, 2000

[51] Int. Cl.[7] ..... A47C 13/00

[52] U.S. Cl. ..... 297/129; 297/DIG. 10

[58] Field of Search ..... 297/463.1, 463.2, 297/313, DIG. 10, 129, 118; 135/65, 66

[56] References Cited

U.S. PATENT DOCUMENTS

| | | |
|---|---|---|
| 3,259,427 | 7/1966 | Wiest . |
| 3,565,485 | 2/1971 | Eisenhauer . |
| 5,375,911 | 12/1994 | Morrow . |
| 5,397,169 | 3/1995 | Willans . |
| 5,662,131 | 9/1997 | Scarborough et al. . |
| 5,950,258 | 9/1999 | Deyne et al. . |
| 5,983,421 | 11/1999 | Waiser . |

*Primary Examiner*—Milton Nelson, Jr.
*Attorney, Agent, or Firm*—Alvin S. Blum

[57] ABSTRACT

Apparatus is provided to assist a person in rising from a seat to a standing position that uses muscles other than leg muscles to accomplish that purpose. The device is portable and may serve as a walking stick or cane in addition to its rising assisting function. The device has a long lever or element with a broad flat enlargement at one end to fit under the buttocks. At the other end is an upright member to be grasped and pushed fore and aft in a rocking motion. On a forceful forward motion, as the free end of the lever is depressed, the bottom of the lever is forced against the upper forward edge of the seat, acting as a fulcrum to force the buttocks upward at the second end of the lever. The torso and arm muscles are thus helping the leg muscles in elevating the person to a standing position.

3 Claims, 2 Drawing Sheets

15
1
19
12

6
2
4
1
12
3
5

11'
17
16
18

11
2
10
14
13
9
7
6
8

APPARATUS ASSISTING IN RISING FROM SEATED POSITION

BACKGROUND OF THE INVENTION

This invention relates to apparatus for assisting a seated person in the act of rising to a standing position, and more particularly to a portable device that can also serve as a cane or walking stick. Many individuals experience difficulty in rising from a seated to a standing position, especially the elderly, obese, and those with weak legs.

DESCRIPTION OF THE PRIOR ART

U.S. Pat. No. 5,397,169 issued May 14, 1995 to Willans discloses a handle apparatus that is anchored to a chair to provide handles extended away from the chair to be grasped by the seated subject to lift the body when the legs are weak.

U.S. Pat. No. 5,375,911 issued Dec. 27, 1994 to Morrow teaches a specially structured chair with two rocking positions to tilt forward to facilitate egress from a chair.

None of the prior art discloses or suggests a portable device for this purpose that actually applies an upward force to the buttocks for rising assistance.

SUMMARY OF THE INVENTION

It is accordingly an object of the invention to provide a device that may be conveniently carried about to serve as a rising assist to enable a person to lift his or her body from a seated position in many of the seats or chairs that may be encountered when traveling, including motor vehicles. It is another object to provide such a device that may also serve as a cane or walking stick. It is yet another object that the device use torso and arm strength to apply an upward force to the buttocks to assist in raising the body from a seated to a standing position.

The device of the invention comprises an elongate, rigid lever or element having at a first end a flat enlargement adapted for positioning between the upper surface of the seat and at least a portion of the user's buttocks. At a second end is located an upright member extending substantially orthogonal to the element and adapted to be grasped by the user. This upright member may be adjustably positioned relative to the first end, and is positionable to lie parallel to the element when not in rising assisting use. The first end may be provided with a handhold so that the device may serve as a walking stick or cane in a second mode of operation.

The device functions as a lift assist apparatus in the following manner:

The flat enlargement is slipped under the buttocks with the second end extending out between the legs and the member directed upward. The user grasps the member with both hands, and alternately pulls and pushes on the member to set up a rocking motion. At the end of an extensive forward rocking motion, the enlargement is providing an upward thrust to the buttocks, with the front edge of the seat acting as a fulcrum to assist the user in standing upright at this moment. This enables a person to use arm and torso strength to assist the legs in standing. These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figures 1, 2, 3, 5:
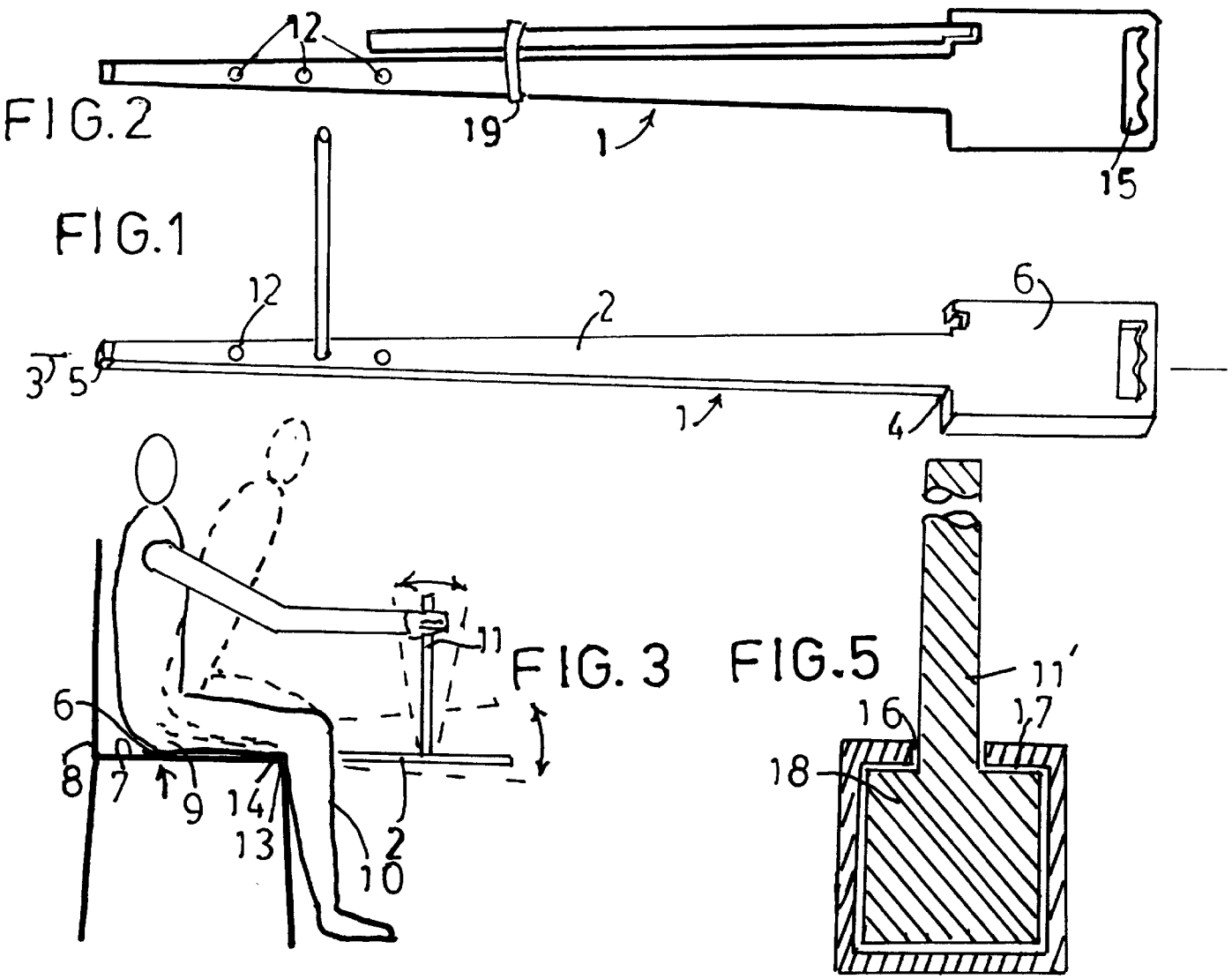
FIG. 1 is a perspective drawing of apparatus of the invention in lifting mode.
FIG. 2 is a plan view of the apparatus of FIG. 1 in walking cane mode.
FIG. 3 is a diagrammatic view of the apparatus in use for lifting a seated person.
FIG. 5 is a sectional view taken through line 5—5 of FIG. 4.

Referring now to FIGS. 1–3, the apparatus 1 comprises an elongate rigid element 2 having a long axis 3, a first end 4, and a second end 5. Attached to the first end is a broad, flat enlargement 6 that extends along the long axis to be effectively positioned between the upper surface 7 of seat 8 and at least a portion of the user's buttocks 9. The user may accomplish this while seated by leaning from side to side. In this position, the rigid element 2 extends horizontally between the user's legs 10. A graspable rigid member 11 extends upwardly when affixed orthogonally to the second end 5. The rigid member 11 is removably affixed to the element 2 by insertion in one of the three holes 12 to adjust the distance to the user's hands. The connection may be a simple force fit, or other means such as, e.g. a threaded connection. When the member 11 is removed from one of the holes 12, it may be stowed parallel to element 2, as shown in FIG. 2. The member 11 may be held in place by strap means 19 well known in the art, such as hook and loop fasteners, for example. In this configuration, the handhold 15, cut in enlargement 6 enables the device to be used as a walking stick or cane.

Figure 4:
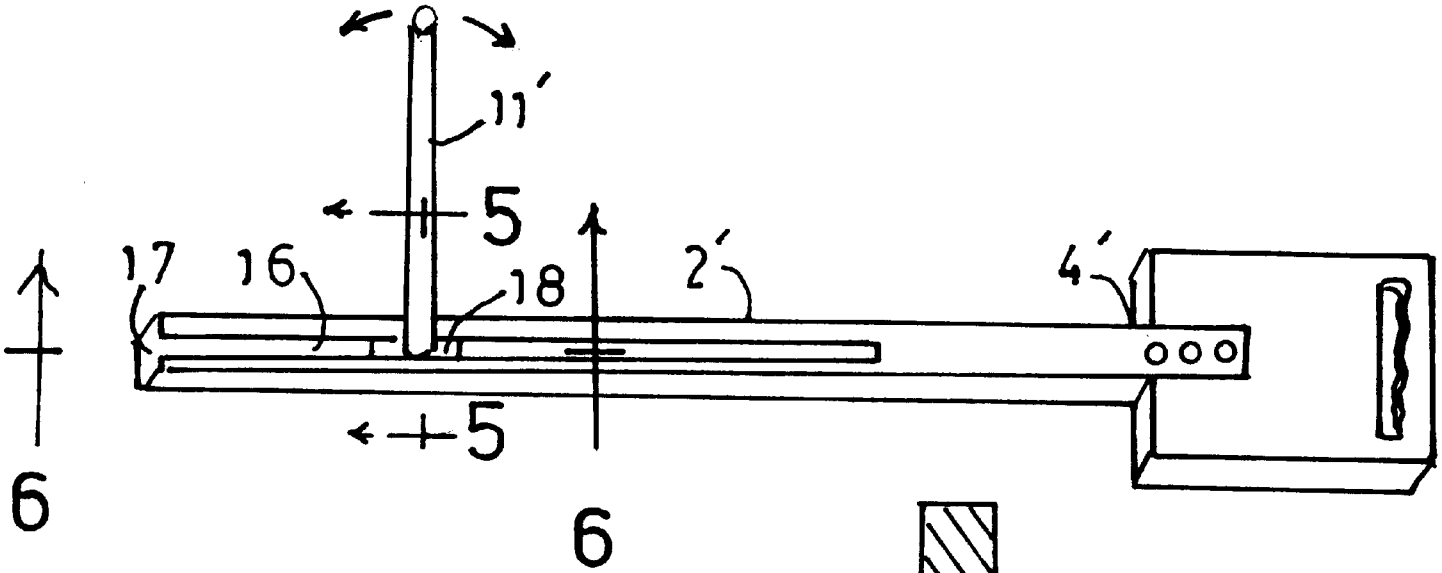
FIG. 4 is a perspective view of another embodiment of the invention.
Figure 6:
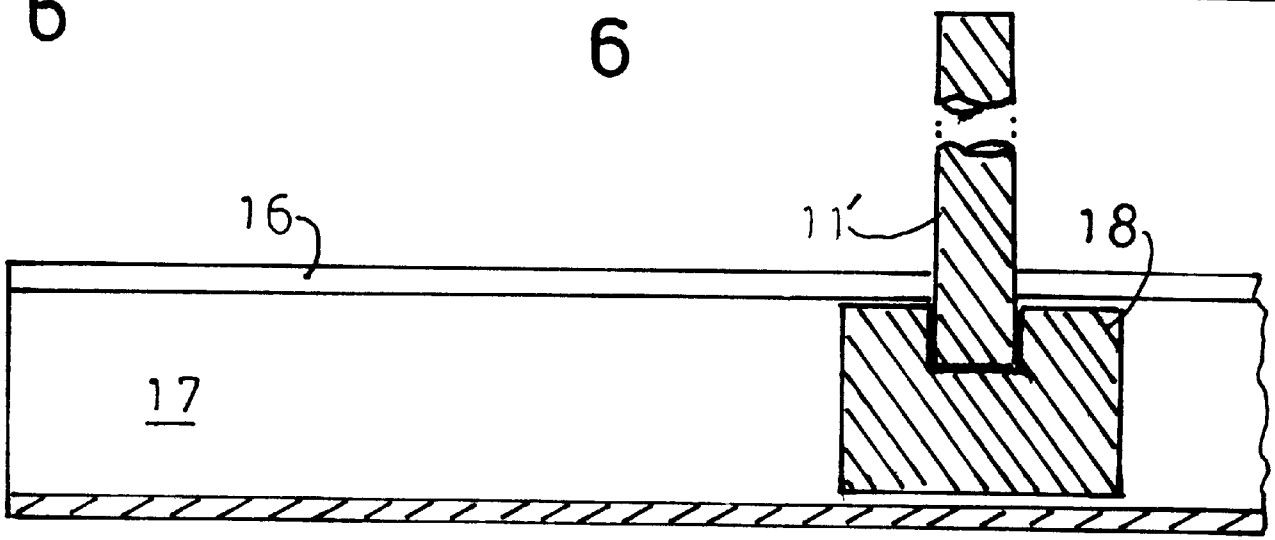
FIG. 6 is a sectional view taken through line 6—6 of FIG. 4.

Referring now to FIGS. 4–6, another embodiment of the invention is shown in which means are provided for connecting the member 11' to the element 2' upright at continuously adjustable distances from the first end 4'. A rectangular passage 17 in element 2' has a slot 16 on one wall. The member 11' terminates in a rectangular portion 18 that slides snugly within the passage 17. Forces at the free end of member 11' hold it in place in the passage. The member 11' may be stored within passage 17 with portion 18 outside when in walking stick configuration.

METHOD OF OPERATION

As best seen in FIG. 3, the seated user grasps the upright member 11 and moves it forcefully alternately toward and away from the body in a rocking motion, using the mass of the upper torso to provide sufficient inertia. At the end of a forceful forward torso and hand motion, the bottom 13 of the element 2 is forced against the forward edge 14 of the seat 8, which acts as the fulcrum of the lever that is element 2. As the second end 5 is forced down, the first end 4 and enlargement 6 are forced upward, thereby applying an upward force on the buttocks to assist the person in rising to a standing position. By this means, the arms and torso muscles may be employed to assist the leg muscles in the act of rising.

The above disclosed invention has a number of particular features which should preferably be employed in combination, although each is useful separately without departure from the scope of the invention. While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. Apparatus for assisting a person in rising from a seat upper surface to a standing position by application of an upward force to the buttocks, the apparatus comprising:

a) an elongate, rigid element having a long axis, a first end, and a second end;

b) a broad, flat enlargement permanently affixed to the first end, extending along the long axis, and constructed for positioning between the seat upper surface and at least a portion of the buttocks with the element extending horizontally between the legs of the person; and c) a graspable rigid member extending substantially orthogonally upward from the second end when the enlargement is beneath the buttocks.

2. Apparatus for assisting a person in rising from a seat upper surface to a standing position by application of an upward force to the buttocks, the apparatus comprising:

a) an elongate, rigid element having a long axis, a first end, and a second end;

b) a broad, flat enlargement affixed to the first end, extending along the long axis, and constructed for positioning between the seat upper surface and at least a portion of the buttocks with the element extending horizontally between the legs of the person;

c) a graspable rigid member extending substantially orthogonally upward from the second end when the enlargement is beneath the buttocks;

d) means removably affixing the rigid member orthogonal to the second end at an adjustable distance from the first end in a first mode of operation for lift assisting and for positioning the rigid member substantially parallel to the long axis in a second mode of operation as a walking stick or cane; and e) the enlargement having a handhold to facilitate use of the apparatus as a walking stick or cane.

3. The apparatus according to claim 2, in which the distance of the upright member from the first end is continuously adjustable.

* * * * *